United States Patent [19]

Harmon

[11] 4,386,517

[45] Jun. 7, 1983

[54] PULLING TOWER STRUCTURE

[75] Inventor: Samuel R. Harmon, Clinton, Iowa

[73] Assignee: Bee Line Company, Bettendorf, Iowa

[21] Appl. No.: 282,675

[22] Filed: Jul. 13, 1981

[51] Int. Cl.[3] ..... B21D 1/12

[52] U.S. Cl. ..... 72/455; 72/705; 269/166; 269/171; 254/112

[58] Field of Search ..... 72/705, 457, 455; 254/108, 112; 269/166, 171, 171.5

[56] References Cited

U.S. PATENT DOCUMENTS

| | | | |
|---|---|---|---|
| 3,566,666 | 8/1968 | Berendt et al. | 72/705 |
| 3,589,680 | 6/1971 | Kuhn | 72/705 |
| 3,992,919 | 11/1976 | Jarman | 72/705 |
| 4,158,303 | 6/1979 | Horn | 72/705 |
| 4,189,934 | 2/1980 | Kuhn | 72/705 |

OTHER PUBLICATIONS

Kansas Jack, Inc. Master Catalog, Jan. 1977, pp. 13, 17 and 26.

*Primary Examiner*—Lowell A. Larson
*Attorney, Agent, or Firm*—Henderson & Sturm

[57] ABSTRACT

A pulling tower structure especially adapted for use in automotive frame-straightening equipment is improved by structure providing easy and simple vertical adjustment of a sheave over which a chain or the like is trained for attachment to a vehicle to be repaired so as to assure a straightline pulley. The tower includes an upright support of channel section having within its side walls a pair of members having semicircular notches for selectively receiving a sheave-supporting shaft. Handle structure is provided for enabling manual vertical adjustment of the sheave among selected pairs of transversely alined notches.

4 Claims, 5 Drawing Figures

PULLING TOWER STRUCTURE

BACKGROUND OF THE INVENTION

Automotive frame-straightening equipment typically includes one or more pulling towers attachable to and adjustable on a bed or frame. The usual tower will include a base affixed to the bed and an upright support rising therefrom and having at its upper end a sheave over which is trained a chain or the like. The tower is hollow or of channel section and the chain extends downwardly inside the tower and is then trained under a second sheave and thence forwardly for connection to the load represented by the damaged part of the vehicle. A hydraulic cylinder is connected to the chain and operates to pull the chain downwardly over the top sheave and upwardly about the second sheave. In order to obtain pulls at the proper angle, it is known to arrange the shaft for the second sheave in such manner that its vertical position can be changed. This is commonly effected by providing the tower with a plurality of vertically spaced openings into selected pairs of which the shaft may be installed. See, for example, the U.S. Pat. No. 3,566,666 to Berendt. The U.S. Pat. No. 3,992,919, to Jarman, shows a portable pulling mechanism in which the upright is provided with a plurality of rearwardly and upwardly inclined slots for selectively receiving a sheavesupporting shaft.

According to the present invention, prior structures are vastly improved by providing within the channel-section tower a plurality of pairs of notches for selectively receiving the shaft. The arrangement is such that the resultant of the pulling forces retains the shaft in its selected notches. Handle means is provided for changing the shaft position when the pulling forces are removed. The handle means is part of a shaft carrier that extends rearwardly into the tower and has a rear portion adapted to ride the rear wall of the tower during changes in the position of the shaft. The interior of the tower is further provided with vertical track means for accommodating the shaft as it is moved vertically among different positions.

DETAILED DESCRIPTION OF THE INVENTION

Figure 1:
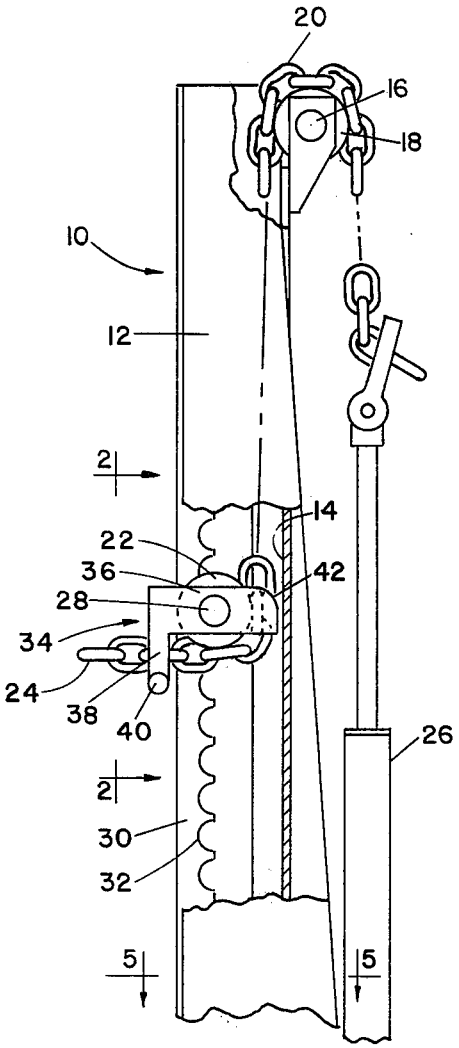
FIG. 1 is an elevation with parts omitted and a portion broken away of a preferred form of the invention.
Figure 2:
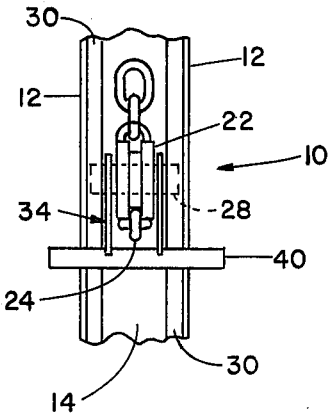
FIG. 2 is a front elevation as seen along the line 2—2 on FIG. 1.

The basic part of the tower involved here is in the form of an upright support 10, preferably a steel channel open at its front and having opposite side walls 12 and a rear wall 14 spanning the side walls. The lower of the upright is affixed to a base or bed (not shown) and the upper end of the upright is open and has bracket or bearing means for supporting a top cross shaft 16 on which is journaled a top sheave 18. A flexible tension element, here a steel chain 20, is trained over the top sheave and extends downwardly within the support and is trained thence under a second or lower sheave 22 which is in substantial vertical alinement with the top sheave. As is customary, the chain extends forwardly at 24 for connection to a load represented by a damaged part of a vehicle (not shown). The other end of the chain is connected to the piston rod of a hydraulic cylinder 26 which is suitably anchored (not shown) to a lower part of the tower.

Figure 4:
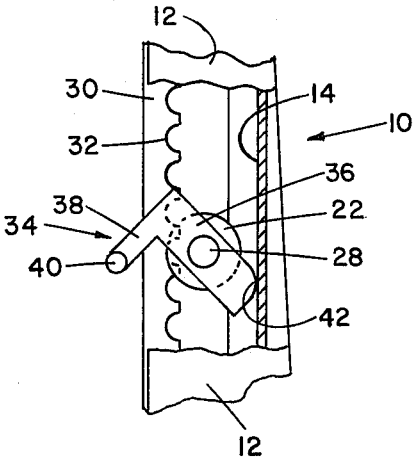
FIG. 4 is a fragmentary view, partly in section, showing how the inner sheave may be released from its retaining notches.
Figure 3:
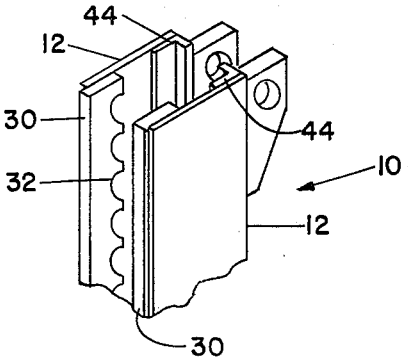
FIG. 3 is a fragmentary perspective of the upper end of the tower.
Figure 5:
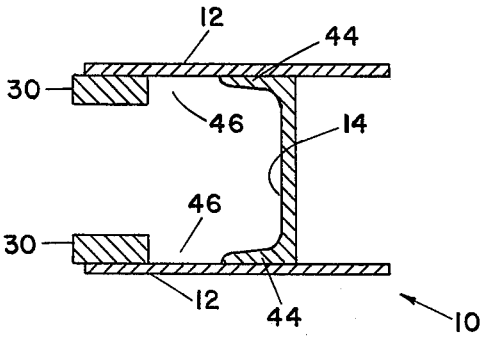
FIG. 5 is an enlarged section of the tower support as seen along the line 5—5 on FIG. 1.

The invention is concerned primarily with mounting the sheave 22 for selective vertical positioning within the tower so as to enable changes in the line of pulling force between the sheave and the damaged vehicle. For this purpose, the sheave 22 is mounted on a cross shaft 28 which spans the interior faces of the side walls 12. The interior face of each side wall has rigidly affixed thereto (as by welding) an upright member in the form of a steel strip 30 having a rear edge portion spaced forwardly from the inner face of the rear wall 14. The strips are identical and each has its rear edge provided with a series of rearwardly opening notches 32. Each notch is preferably semicircular on a radius substantially equal to that of the cross shaft 28. The strips are positioned so that pairs of notches are alined cross wise of the vertical length of the upright, and the shaft may be selectively nested into any pair of alined notches. As will be seen in FIG. 1, the resultant of the pulling forces on the chain is upwardly and forwardly, tending to keep the shaft in the selected pair of notches. Since the notches are spaced ahead of the rear wall 14 a substantial distance, the sheave 22 and its shaft may be manually moved rearwardly to disengage the shaft from a pair of notches for changes in its vertical position. To facilitate this, the shaft is carried on a positioning means in the form of a carrier 34, here an L-shaped structure having a pair of horizontal legs 36 and a pair of forwardly disposed depending arms 38 cross-connected by handle means 40 arranged ahead of the open front of the upright, through which the carrier extends. The rear parts of carrier legs lie in close proximity to the rear wall 14 of the support and thus prevent direct rearward disengagement of the shaft from a pair of notches. The upper rear corner of each leg 36 is shaped on a radius, as at 42, to enable clockwise rocking of the carrier (FIG. 4) to enable such disengagement when the chain forces are removed.

Also provided within the support are a second pair of strips 44 spaced rearwardly from the notched strips sufficiently to accommodate the shaft when it is disengaged. The ends of the shaft will be guided by the track means 46 thus provided, and the rear part of the carrier will be able to ride the rear wall 14 during vertical adjustment of the sheave. Moreover, the greater part of the weight of the carrier, shaft 28 and sheave 22 is ahead of the axis of the shaft and thus biases the carrier in a counterclockwise direction.

As already noted, the carrier is used to disengage the shaft 28 from a pair of alined notches for movement to another pair consistent with the line of force to be exerted by the chain at 24. When the desired position is attained, the operator releases the lifting force he was exerting on the carrier and the carrier rocks to its retained position, in which it is kept when forces are exerted on the chain. When this force is removed, the position of the sheave 22 is easily changed by clockwise rocking of the carrier. The adjustment is made easy by the guiding of the ends of the cross shaft in the tracks 46 and the ability of the rear part of the carrier to ride the rear wall 14. The structure is simple and efficient and the carrier, shaft and sheave, being captive within the tower, cannot be lost or misplaced. Other features and advantages not enumerated herein will be recognized by those versed in the art, as will many modifications in the preferred embodiment disclosed, all of which may be achieved without departure from the spirit and scope of the invention.

I claim:

1. Pulling tower structure comprising: a vertically elongated, upright support having a pair of parallel side walls spaced apart transversely of the height of the support and rigidly cross-connected in such manner as to leave the support open at its front, a top sheave vertically alined with the interior of the support and journaled on the support adjacent to its upper end on an axis normal to the planes of the side walls, a pair of vertically elongated upright members disposed within the support and secured respectively to the side walls in transversely spaced apart relation, said members respectively having rear edge portions and each edge portion having a plurality of vertically spaced apart notches opening to the rear of the support and the notches in each member being respectively transversely alined with those in the other member, a cross shaft disposed within the support and having opposite end portions selectively receivable by any selected pair of transversely alined notches, a second sheave carried by the cross shaft between the members and below the top sheave, a flexible tensionable element trained over the top sheave and extending downwardly to and under the second sheave and thence forwardly through the open front of the support for connection to a load, a second pair of vertically elongated upright members secured respectively to the interiors of the side walls and spaced rearwardly from the respective notched members by a distance at least equal to the diameter of the shaft end portions, said second members and notched members combining to provide a pair of vertical tracks for guiding the shaft end portions during vertical movement of the shaft and second sheave to new positions, and positioning means connected to the cross shaft for manually moving the cross shaft rearwardly out of such selected pair of notches for vertical re-positioning thereof in another pair of alined notches after the forces of the element are removed.

2. Pulling tower structure according to claim 1, including rear means substantially closing the rear of the support to prevent total escape of the shaft and second sheave from the upright, said rear means being spaced rearwardly of the notched members a horizontal distance sufficient to enable disengagement of the shaft end portions from a selected pair of notches.

3. Pulling tower structure according to claim 2, including stop means associated with the positioning means and disposed interiorly of the upright and extending rearwardly into proximity to the rear means to prevent direct rearward disengagement of the shaft end portions from a selected pair of notches, said positioning means being rockable upwardly about the axis of the shaft to move the stop means downwardly and away from the rear means a sufficient amount to enable disengagement of the shaft end portions from a pair of notches.

4. Pulling tower structure according to claim 3, in which the stop means has an upper rear corner shaped to ride against the rear means during vertical positioning of the shaft and second sheave.

* * * * *